US006087962A

United States Patent [19]

Rojas

[11] Patent Number: 6,087,962

[45] Date of Patent: Jul. 11, 2000

[54] ELECTRIC TRAFFIC LIGHT, WITH ACOUSTIC SIGNS AND WITH AN INDICATION OF BACKWARD COUNTING

[76] Inventor: Hector Reynaldo Rojas, San Martin 686- 7°fl. of. 72, 1004 Buenos Aires, Argentina

[21] Appl. No.: 09/296,221

[22] Filed: Apr. 23, 1999

[51] Int. Cl.[7] ..... G08G 1/095

[52] U.S. Cl. ..... 340/907; 340/929; 340/925; 340/906; 340/944

[58] Field of Search ..... 340/907, 929, 340/925, 906, 944, 43, 44

[56] References Cited

U.S. PATENT DOCUMENTS

| | | | |
|---|---|---|---|
| 3,134,089 | 5/1964 | Bogoff et al. | 340/44 |
| 3,320,585 | 5/1967 | Hines | 340/43 |
| 3,480,909 | 11/1969 | Hines | 340/43 |
| 5,241,307 | 8/1993 | Bidault et al. | 340/944 |
| 5,519,390 | 5/1996 | Casini | 340/929 |
| 5,892,461 | 4/1999 | Dokko | 340/907 |

*Primary Examiner*—Jeffery A. Hofsass
*Assistant Examiner*—Phung Nguyen
*Attorney, Agent, or Firm*—Pendorf & Cutliff

[57] ABSTRACT

The electric traffic light, with acoustic signs and with an indication of backward counting includes lights prepared in three sectors with signaling screens that are controlled by a processor electrically linked to an optic and numeric counter. The circuit of optic formation is programmed in sequence and time to emit activation signals to certain sections of the lights to provide the brightness of the light on each screen. The circuit of the numeric formation is programmed to send signals of interruption of the power supply, simultaneously with the optic circuit, to certain sectors of the lights to provide visualization of numbers. Further, simultaneously with the optic and numeric circuit, a sound emitter emits a sound with each color.

1 Claim, 2 Drawing Sheets a
b
c
d
d2
d3
d4
d
1
2
3
4
5
6
7
8
9
10
11
12
13
14
15
16
17
18
19
10
≈ X
≈ Y
≈ Z
≈ Y
≈ X

ELECTRIC TRAFFIC LIGHT, WITH ACOUSTIC SIGNS AND WITH AN INDICATION OF BACKWARD COUNTING

BACKGROUND OF THE INVENTION

1. Field of the Invention

The present invention refers to a traffic light and more particularly to an indicative device that emits information signs relative to traffic.

The device according to the invention increases the information of the signaling with regard to the conventional signs, in order to provide more security to pedestrian and drivers.

2. Description of the Relate Art

The information emitted at the moment by the traffic lights is insufficient for the user therefore, generating, multiple risky situations and/or accidents.

At the moment, the traffic lights only emit optic signs that do not include temporization indicating the progression of the cycle.

Instead, in the display of traffic light of the present invention, as well as the conventional signs already mentioned, a numeric sign and a sonorous sign are also emitted.

The current traffic lights do not provide with enough advance the moments of change of the cycle of signaling of each illumination color, which in fact originates, the multiple risky situations and/or accidents with the well-known fatal results.

By means of the traffic light of the present invention advanced and constant information of the progress of each signaling cycle is delivered, allowing the certain knowledge of the available time to cross or to stop in front of the corresponding lights without alarm or haste.

The main advantage of this device is that a printed numeration in each screen of the lights can be seen which, counting backward, indicates the time left of the color in signaling activity, in consequence, allowing to the pedestrian or driver to take the corresponding attitude: that is, to cross the intersections without alarm with the green light or to stop quietly before the red light waiting the printed numeration to indicate the moment of change of each optic sign in advance.

In the same manner concerning the pedestrian, as opposed to the detention sign, the sign of free traffic is activated, which, with the system of progressive numeration printed on said activated screen, informed also the time to prepare for a safe crossing of the street.

The other sign that includes this new traffic light consists on a sound system, synchronized with the optic sign and the numeric sign that informs with a characteristic sound, distinguished for each light color, which is the color that begins its signaling activity.

Therefore, the innovation of the present invention is that three simultaneous traffic signs are issued to drivers and pedestrians, instead a single one as it happens at the present time.

Furthermore, the innovation in the signs just mentioned is that the new device contains the advantage that gives security to blind persons, by means of the sound sign which is the color of the light that begins its signaling activity, since, as it was already discussed, each light color corresponds to a particular distinctive sound.

Another advantage that distinguishes this new device is the employment of the latest electronic technology that commands the device totally.

A functional advantage is manifested in the long useful life of the components of the device, which avoids the constant replacement of parts, like it happens at the moment, being demonstrated by the frequency in which traffic lights are out of service.

The economic advantages are given by the reduction of maintenance costs and reinstatement of parts as consequence of the useful life of the electronic components included in the invention.

Devices of this type are known by the following Argentinean patents of invention 197.379; 211.278; 211.822; 232.525, 237.626 and 244.452.

Patent 197.379 refers to an electromechanical device that includes a am lever electric motor, while the present invention is totally of electronic working.

Patent 211.278, discloses an entrance of alternate current with a stage conforming the duration of the ignition of the Red, Yellow and Green incandescent lights (R.A.V.). Even though the present invention is also about an electronic integral traffic light with Red, Yellow and Green lights (R.A.V.) it also counts with acoustic signs and of backward counting.

Patent 211.822, refers to a coordinator to create a fundamental cycle and logic conditions controlled in output circuits and concerns in a limited manner the use of the cycles to create a binary configuration to control the signaling of a traffic intersection. Our invention is about an electronic integral traffic light of R.A.V. lights with acoustic signs and backward counting, to control the mentioned traffic and crossing of pedestrians.

Patent 232.525 is a process and circuit disposition to watch over dispositions of traffic signaling fed with alternating current. Said patent discloses a device with sensors in the sign emitters for the incandescent lamps used in the traffic lights, technique that is very different to the employed in the present invention and it also is not about a traffic light with acoustic signs and backward count.

Patent 237.626, refers to a traffic light with continuous indication of its cycle, indication that is made by means of an indicative revolving needle of the cycle. Resource that the present invention does not use.

SUMMARY OF THE INVENTION

The main object of the invention is a traffic light of the type that uses lights prepared in three sectors in its signaling screens, different by their placement and internationally normalized color regulation. Its novelty consists in that the screens are controlled by a processor electrically linked to an optic and numeric counter and, in turn, to a device emitter of sounds in which each sector houses a plurality of lights fed by independent sections, which are connected electrically from said optic and numeric counter whose circuit of optic formation is programmed in sequence and time for the emission of activation signals to certain sections of the lights providing the brightness of the light on each screen. Simultaneously, the circuit of the numeric formation of said counter is programmed to send signals of interruption of the power supply to certain sectors of the lights, providing visualization of numbers in backwards counting, formed by contrast, between the lights with activation signals and lights with interruption signal, simultaneously and at the beginning of each traffic light activation, said sound emitter is connected electrically to an acoustic means installed in the screen that will receive and emit a distinctive audio-frequency signals for each one of the colors of the screens.

BRIEF DESCRIPTION OF THE DRAWINGS

The main object as the advantages will be able be fully appreciated in the following description of the preferred embodiment of the invention, with references to the drawings, in which.

Figure 1:
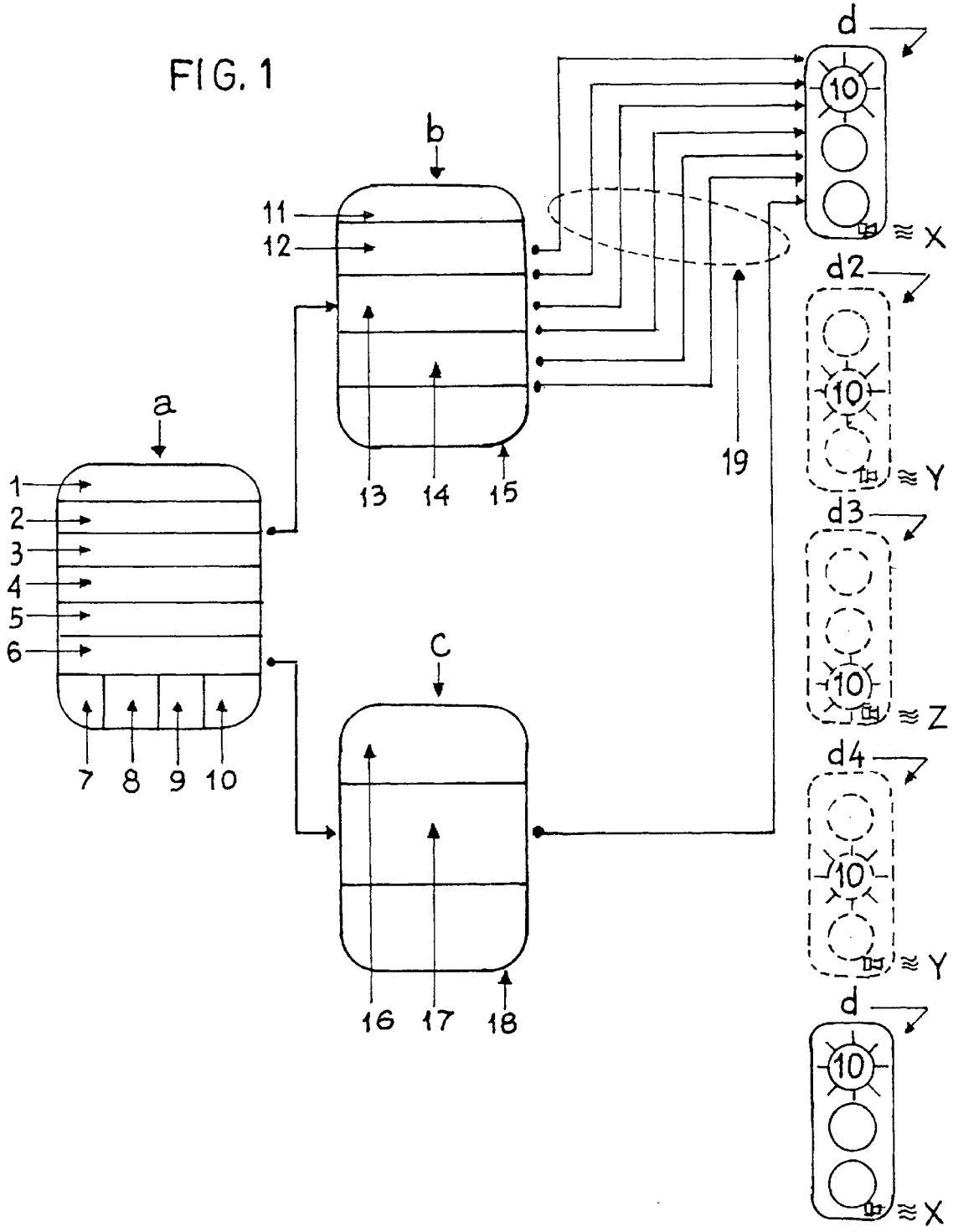
FIG. 1 is an outline of the device of the invention.

As it can be appreciated in the drawings, the invention is an electronic traffic light, with acoustic signs and with an indication of backward counting.

DETAILED DESCRIPTION OF THE PREFERRED EMBODIMENTS

The device operates as follows: at the beginning ol the cycle of signaling activity of the red light, the printed figures corresponding to the number 10 are displayed in the screen simultaneously and, in turn, a sound with a characteristic frequency assigned to that light will be heard. While the activity cycle continues, in which said red light remains lit, the number 10 present in the screen modifies in such form that a backwards counting begins, passing its value to 9, 8, 7, . . . 2, 1 and 0, instant in which the cycle of activity of said light ends. Then, in accordance with the predetermined modality, the activity cycle corresponding to the sign of the yellow or amber light begins, the figures corresponding to the number 10 being also displayed simultaneously printed on said light and, in turn, a sound of a frequency assigned to said yellow light will be heard, the number 10 present on the same modifies, and begins a backwards counting, passing to 9, 8, 7 . . . 2, 1 and 0 instant in which the activity cycle of the yellow or amber light ends.

Immediately and in accordance with the norms, the signaling cycle corresponding to the green light will begin, the number 10 being presented simultaneously printed in this light and in turn a sound of a frequency assigned to this green light will be heard. Also the number 10 printed on the same modifies, beginning a backwards counting, passing to 9, 8, 7 . . . 2, 1 and 0 instant in which the activity cycle of the green light ends. This sequence of signaling functions just described will go on continually according to the times programmed for each one of the cycles of the device.

Next, a preferred embodiment of the invention is described, like the one that is illustrated in FIG. 1: the traffic light (d) houses the three screens 20 with the corresponding lights 21 and a sound system 22, which is diagramed with full lines, being interconnected to the specific systems of feeding emission to the lights, numeration and sound systems for the drivers, according to the following sequence:

The first graph (d) in FIG. 1 represents the ignition of the red light with the number 10 and the sound sign (X) of a first predetermined frequency.

The second variant (d2) in FIG. 1, in dotted lines, represents the ignition of the yellow light with the number 10 and of the sound sign (Y) of a second predetermined frequency.

The third representation (d3) in FIG. 1, in dotted lines, represents the following activation sequence or ignition of the green light with the number 10 and of the sound sign (Z) of a third predetermined frequency. The sequence just described shows half of a signaling cycle, that is, from a light up to third with its corresponding activation moment.

In FIG. 1, by means of the representation (d4), in dotted lines, the return sequence where the ignition of the green light is left again with the number 10 and the sound sign (Y), is also shown, after which it returns to the beginning of the representation (d) in full lines.

The printed numeration in each light always begins synchronized with the beginning of activation of said light and it is during the permanency of the cycle that the backwards counting takes place from 10 to 0.

This indication is the one that constantly informs on the moment of the cycle in which the light is activated.

Therefore, the backward counting informing which is the quantity of pulses that are left is constant so that it ends the period of activation of that light.

It is a fundamental condition the count to always begin with the number 10 and that it concludes with 0, that makes the pedestrian or driver to know in each moment how many pulses are left to the end of the period of activation of the light.

In consequence, the count does not refer to chronological time but to pulses with the chronological duration being a fraction of the period of activation of the signal, in this case, the tenth part of the time set for the activated presence of said light.

As it is known, in the case of the signal destined to pedestrians the mentioned activated presence of each light will be determined by the width of the roadway.

As it is observed in FIG. 1, the invention also includes a logical process controller (a), including a microprocessor of programmable logical control (1), a glass Oscillator (2) for the order of ignition of lights, a controller Oscillator R.C. (3), an Oscillator of numeric formation (4), an Oscillator R.C. originator of audio order (5), an inlet that contains an on/off control (6), a synchronizer with other traffic lights (7), an originator of internal functions programmed toward a verification/controller center of functions of permanency of the desired lights R.A.V. (8) combined with a receiver of external orders programmed from a verification and control center of functions (9) and a source of electric supply (10).

This mentioned controller of process (a) is electrically connected to an optic and numeric counter (b) and to a sound device (c).

The optic and numeric counter (b) presents an ignition actuator of lights R.A.V. (11), a self-control of ignition sequence (12), an actuator of permanency of ignition of lights R.A.V. (13), an actuator sign with interruption for numeric formation (14) and a self-control of sequence inactivation (15).

The sound device (c) presents an oscillator of characteristic audio-frequencies connected with lights R.A.V. (16) an ignition actuator (17) and a disconnection actuator (18).

The devices a), b) and c) just mentioned are linked to the body of the traffic light (d) by means of electric connections (19) that transmit the emission and no emission orders for optic, numeric and sound activation.

Figure 2:
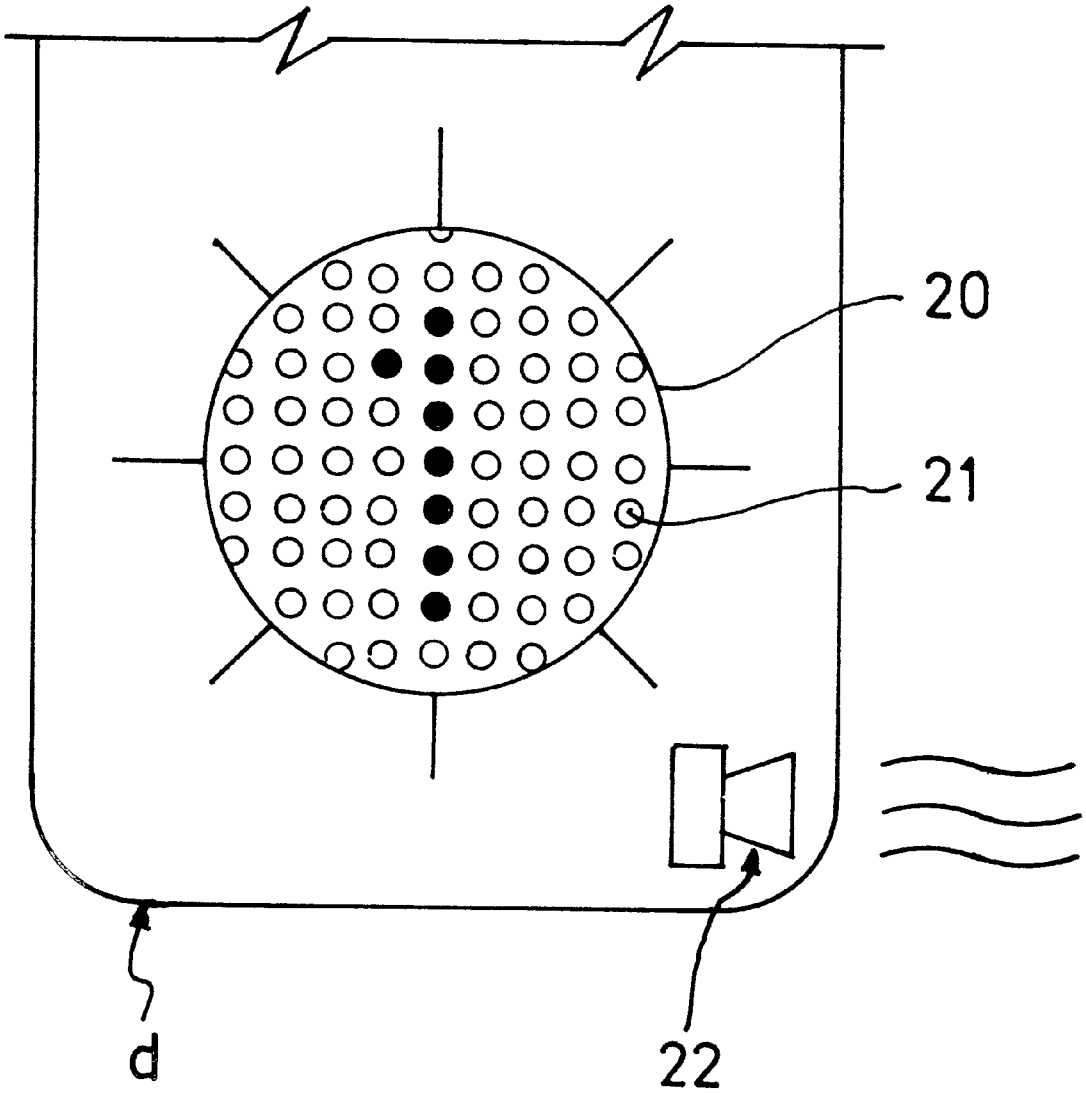
FIG. 2 is a detail of how the sign is shown in one of the screens of he device.

In FIG. 2 it can be observed that the screen of each one of the lights is constituted by a plurality of lamps that emit light of each one of the colors corresponding to the position of the light in the traffic light disposed in lines and columns, in a such way that when some of them light and others riot, the figure that the circuits of control of numeric formation determine, appears in the light.

The device of traffic light of the present invention is adaptive to the existent facilities, as well as the necessary supply of electric is the one available at the moment.

The consumption of this electric power is similar to that of the well-known current systems, which allows maintaining the primary sources of supply.

What is claimed is:

1. A traffic light that uses lights prepared in three sectors in its signaling screens, different by their placement and internationally normalized color regulation; characterized because it consists in that the screens are controlled by a processor electrically linked to an optic and numeric counter and, in turn, to a device emitter of sounds in which each sector houses a plurality of lights fed by independent sections, which are connected electrically from said optic and numeric counter whose circuit of optic formation is programmed in sequence and time for the emission of activation signals to certain sections of the lights providing the brightness of the light on each screen; simultaneously, the circuit of the numeric formation of said counter is programmed to send signals of interruption of the power supply to certain sectors of the lights, providing visualization of numbers in backwards counting, formed by contrast, between the lights with activation signals and lights with interruption signals, simultaneously and at the beginning of each traffic light activation, said sound emitter is connected electrically to an acoustic means installed in the screen that will receive and emit a distinctive audio-frequency signal for each one of the colors of the screens.

* * * * *